US010787778B1

(12) United States Patent
Swiryn

(10) Patent No.: US 10,787,778 B1
(45) Date of Patent: Sep. 29, 2020

(54) ELITE DOGGIE CLEAN UP

(71) Applicant: Scott Swiryn, Citrus Heights, CA (US)

(72) Inventor: Scott Swiryn, Citrus Heights, CA (US)

( * ) Notice: Subject to any disclaimer, the term of this patent is extended or adjusted under 35 U.S.C. 154(b) by 0 days.

(21) Appl. No.: 16/428,881

(22) Filed: May 31, 2019

(51) Int. Cl.
*E01H 1/12* (2006.01)
*B65F 1/00* (2006.01)

(52) U.S. Cl.
CPC ..... *E01H 1/1206* (2013.01); *B65F 1/0006* (2013.01); *B65F 2240/136* (2013.01)

(58) Field of Classification Search
CPC ..... E01H 1/1206; E01H 2001/1273; E01H 2001/1266; E01H 2001/128; E01H 2001/1286; E01H 2001/1246; E01H 2001/1293; B65F 1/0006; B65F 2240/136
USPC ..... 294/1.3, 1.4
See application file for complete search history.

(56) References Cited

U.S. PATENT DOCUMENTS 4,010,970 A * 3/1977 Campbell ..... A01K 23/005 294/1.5
7,992,907 B1 * 8/2011 DeJesus ..... E01H 1/1206 294/1.4
8,292,339 B1 * 10/2012 Auseklis ..... E01H 1/1206 294/1.4
2008/0276883 A1 * 11/2008 Perez Tomas ..... A01K 27/004 119/798
2010/0096867 A1 * 4/2010 Flinn ..... E01H 1/1206 294/1.4
2014/0137811 A1 * 5/2014 Kovarik ..... B25J 1/02 119/796
2015/0042112 A1 * 2/2015 Briski ..... E01H 1/1206 294/1.4
2015/0230811 A1 * 8/2015 Kovarik ..... A61B 17/22031 433/29

* cited by examiner

*Primary Examiner* — Stephen A Vu

(57) ABSTRACT

The Elite Doggie Clean-Up is a one of a kind, portable easy clean up unit. Used for while walking your dog and when picking up your dog's poop. It is very good for owners with back, hip and knee issues including owners with handicap needs. The Elite Doggie Clean up allows all dog owners never have to bend over to pick up or touch the poop during the entire pick up and throw away process.

8 Claims, 10 Drawing Sheets

CAM SYSTEM 14

ELITE DOGGIE CLEAN UP

FIELD OF THE INVENTION

The Elite Doggie Clean Up is a one of a kind, portable easy clean up unit. Used while walking your dog and for picking up your dog's poop. The Elite Doggie Clean Up system makes it much easier so that the dog owner does not have to ever bend down and pick up or feel the poop by hand.

DESCRIPTION OF THE RELATED ART

Cleaning up poop is an inevitable part of dog ownership. Poop scoopers have a (swivel or) fixed bin and a pole connector for height adjustment. Poop scoopers have a spring controlled jaw or, tray and a rake combination. The jaws are made of metal or plastic. Most scoopers do not have a self locking mechanism and some motion of hands is involved in picking up of the poop. Poop tends to stick to the serrated teeth on the jaws and tend to scratch surfaces/grass pickups. Some of the more expensive scoopers have extensive and involved clean-up process. For many operators who have small hands and including the elderly, poopers with spring mechanisms are too hard to squeeze, hold and operate. The rake and tray combination units are cumbersome and not convenient to being carried along with a walking dog. Dog owners usually complain when they have to pick up the poop by hand as they have to feel it.

SPECIFICATIONS

Figure 1:
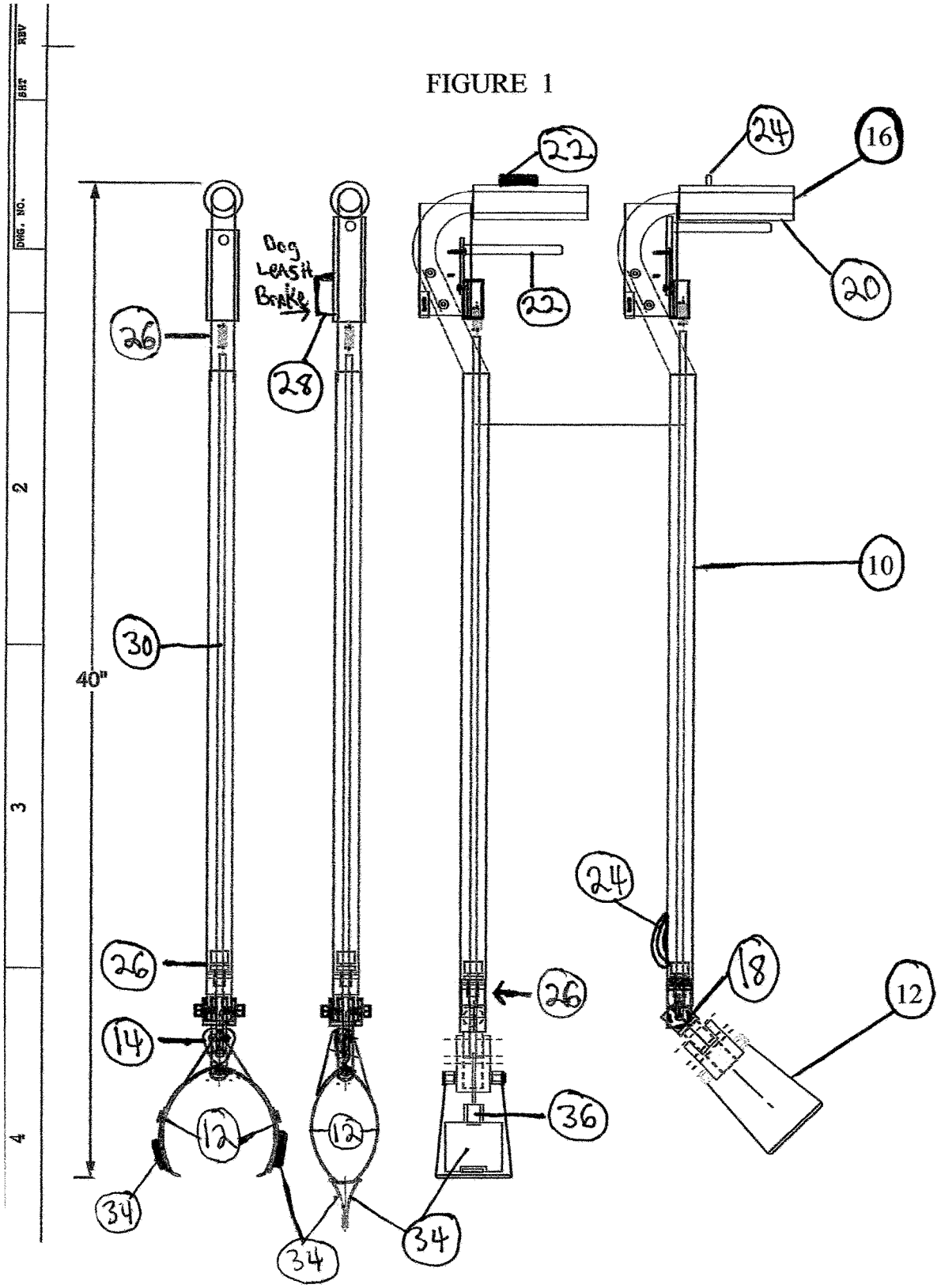
FIG. 1 shows the Elite Doggie Clean up system with swivel mechanism and handle.
Figure 2:
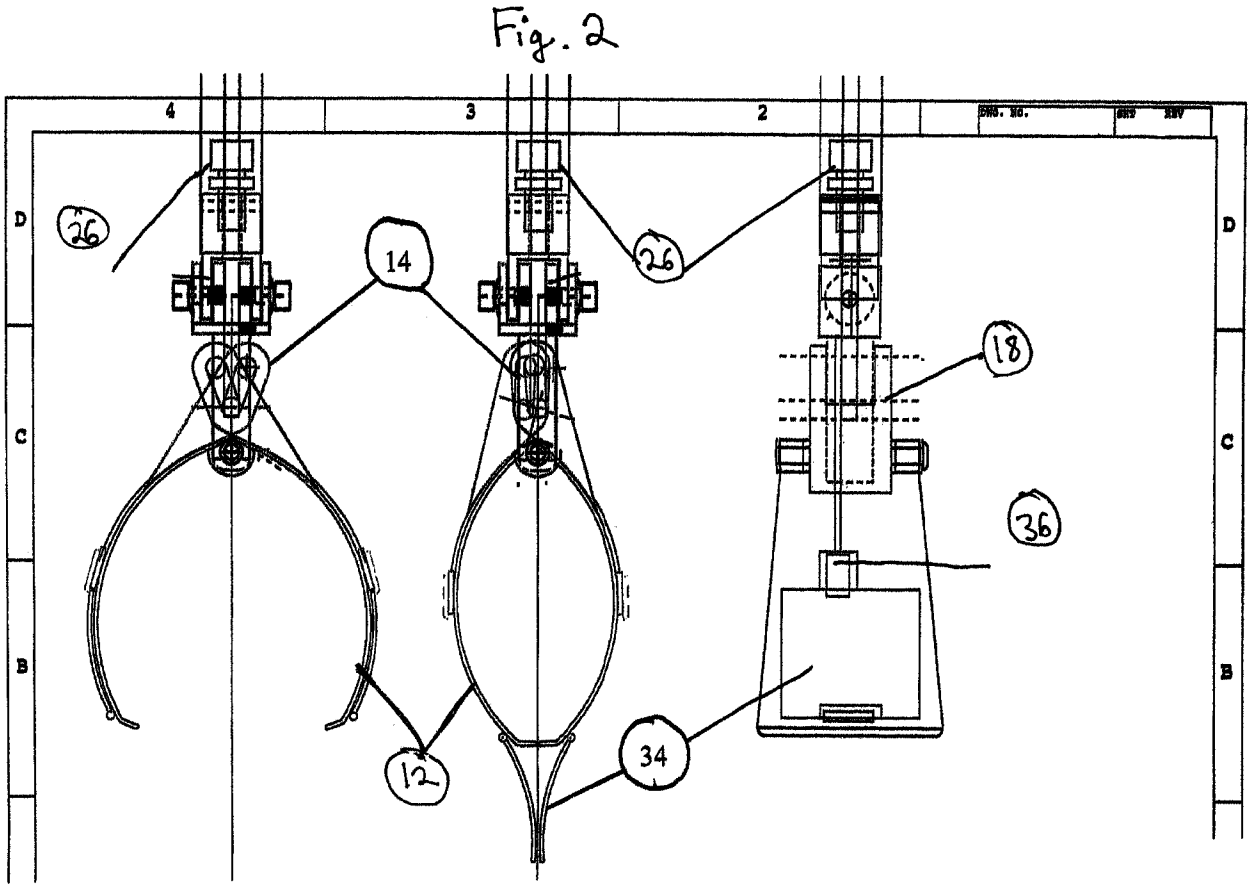
FIG. 2 shows the claws with the plates and is the preferred embodiment.

The invention consists of an adjustable height light weight durable pole which bends at continuous angles, not limited to 90 degrees. This feature enables the use of the device for wheel chair users too and for people to adjust it to their heights so it can be also be used for support during walking.

The main tube (10) is a light weight hollow tube. It has cables within it to operate the claws (12) which has two positions open and closed. The claws are attached to a specially designed cams (14) that allows the tube to be pivoted from a 90 degree to a 45 degree position, but not limited to these angles, adjusting to the operators height whether standing or sitting. One end of the main tube has a handle (16) attached. The other end of the handle has claw cam box (18) attached which can swivel.

The handle (16) consists of an easy grip (20) shaped for comfort. It also consists of one or two triggers (22), flashlight (24), cable clamp (26), and a dog leash brake (28).

The claws (12) are attached to the main tube (10) by specially designed cam claw box which opens and closes the claws. The claws are connected to the claw cams by rivets or screws and the claw clams movement is controlled by string wires (30) which in turn is connected to the trigger (22), specially designed trigger lock mechanism (32). The claws have a substantial opening range for most size of poop. The claws staying in the open or closed position is controlled by a set of cable clamps (44), a push pull mechanism (46) and cables.

The ends of the claws have a plate (34) attached one on each side of the outer edge. The plate is spring (36) loaded and is held in place on the outer edge of the claw for release with a second trigger. The first trigger can be used if additional functions are designed into the first trigger.

A specially designed plastic bag (38) can be rolled over the claws (12) and the plate (34). The plastic bag has two sets of Velcro (42, 66) attached on the inside of the bag placed at specific designed distances from each other. This one-of-a-kind hands free double seal velcro design ensures that the double sealed bag will not drip or leak the poop out of the bag.

Figure 3:
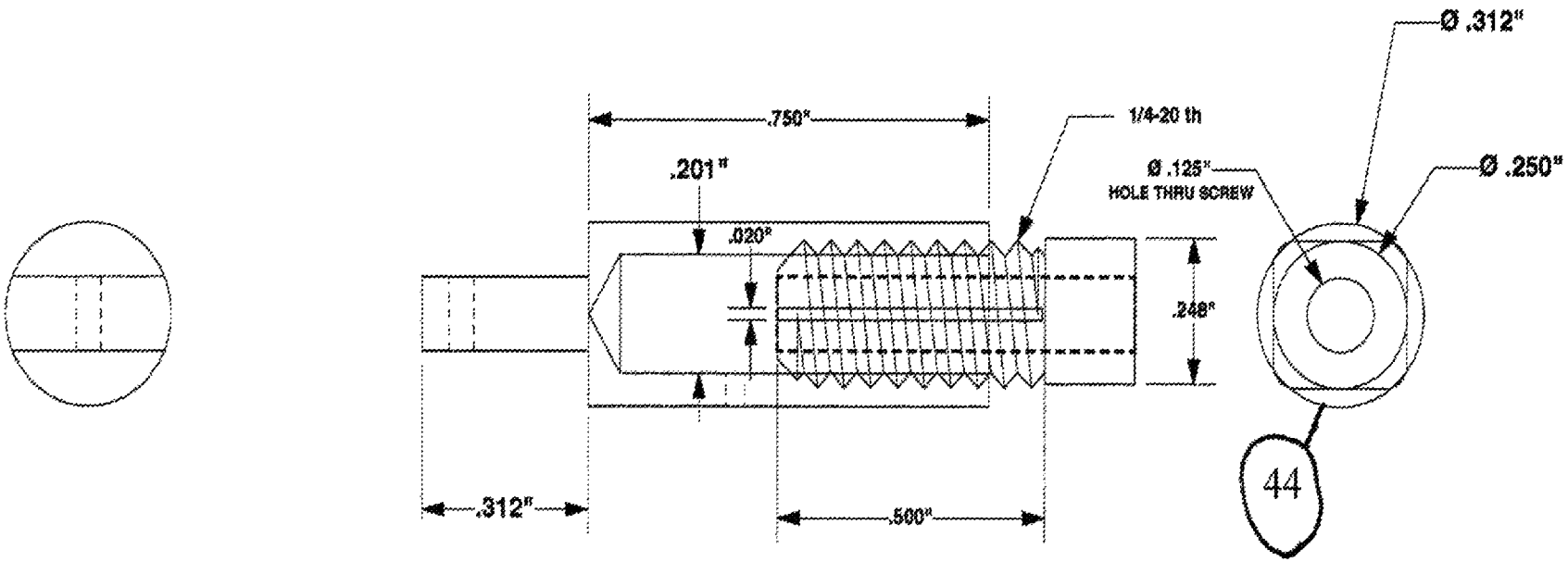
FIG. 3 shows the cable clamp mechanism that helps to lock claws in place when triggered.
Figure 4:
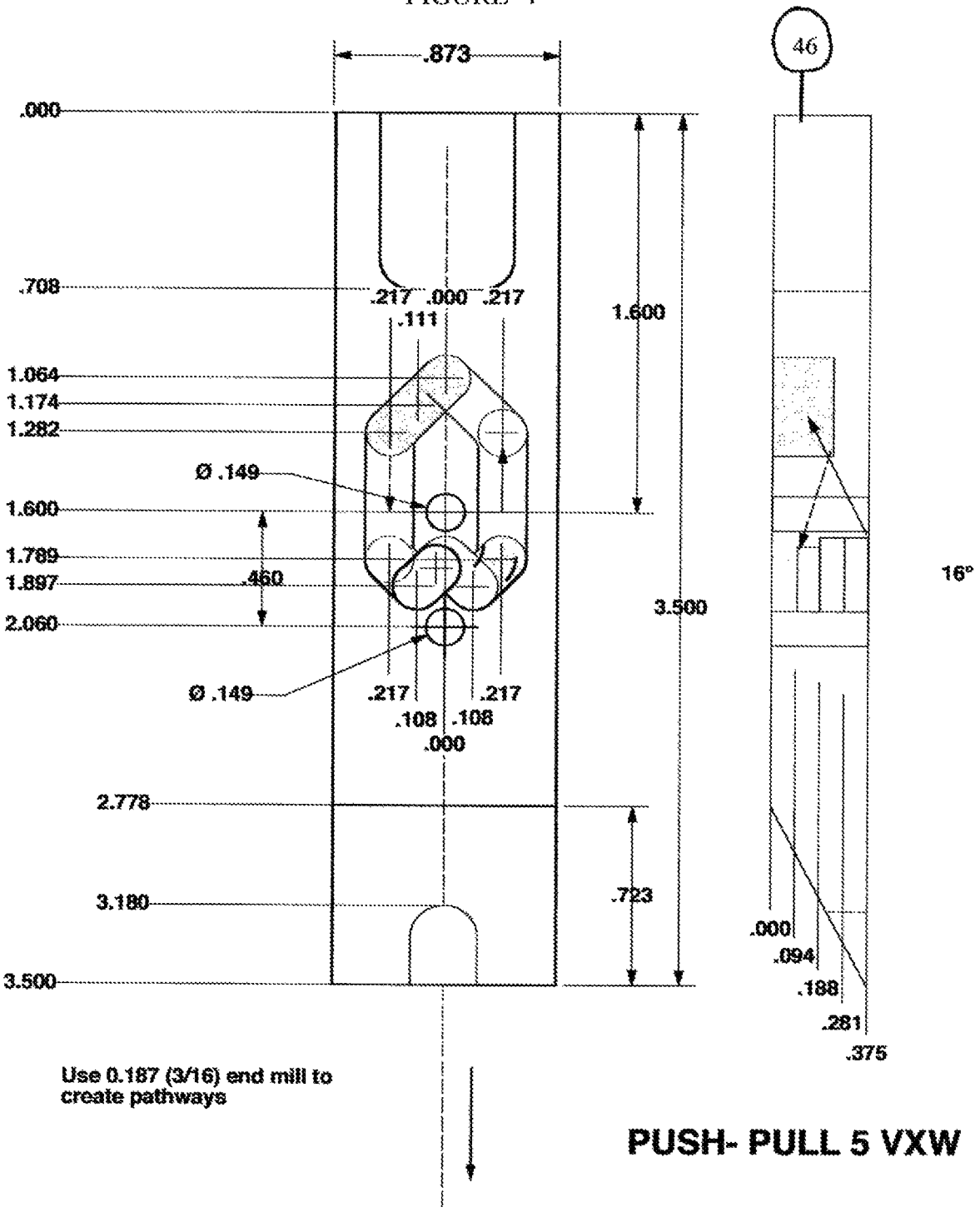
FIG. 4 shows the push-pull mechanism.
Figure 5A:
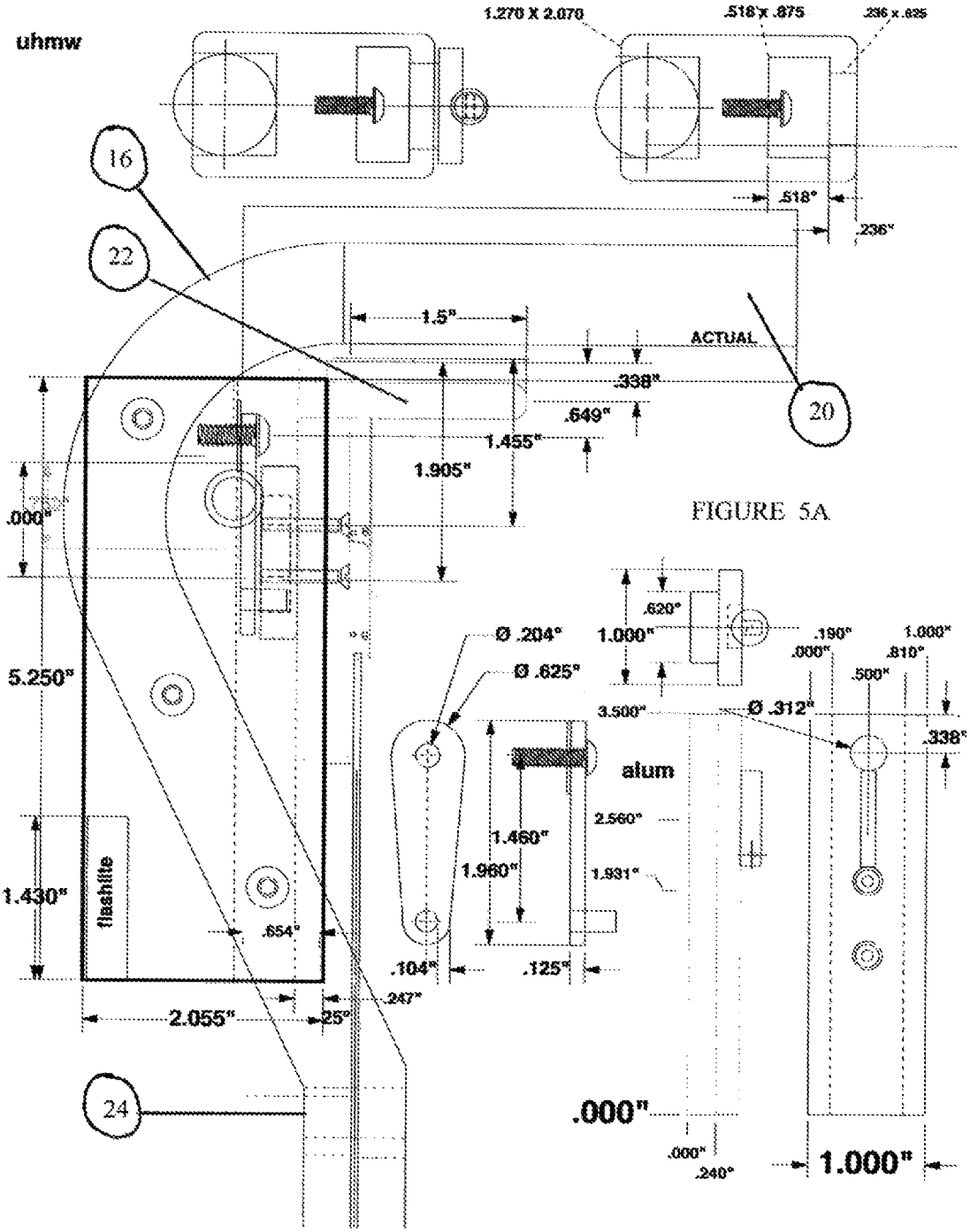
FIG. 5 shows the handle with the easy grip, flashlight, trigger and various other parts.
Figure 5B:
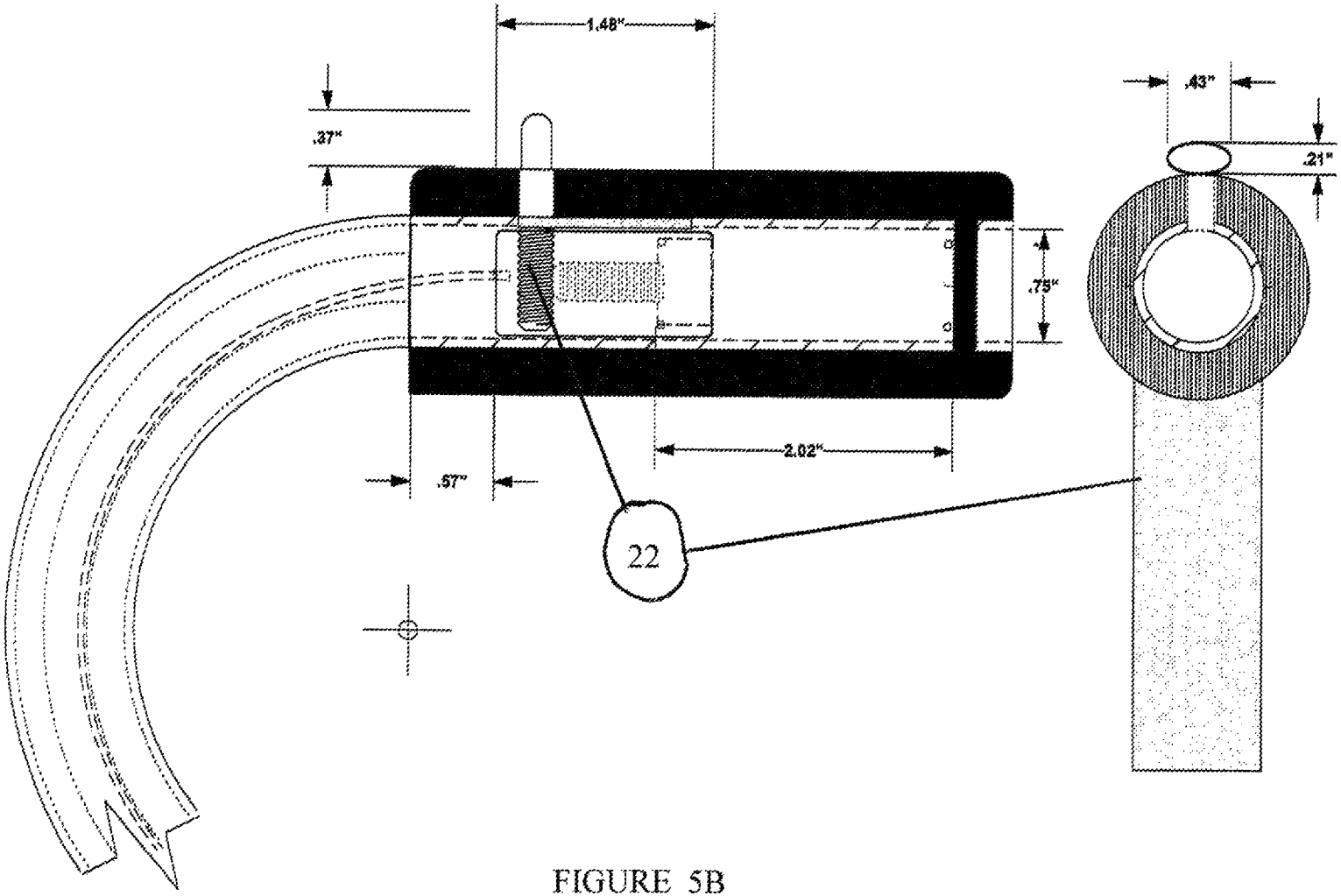
Figure 6:
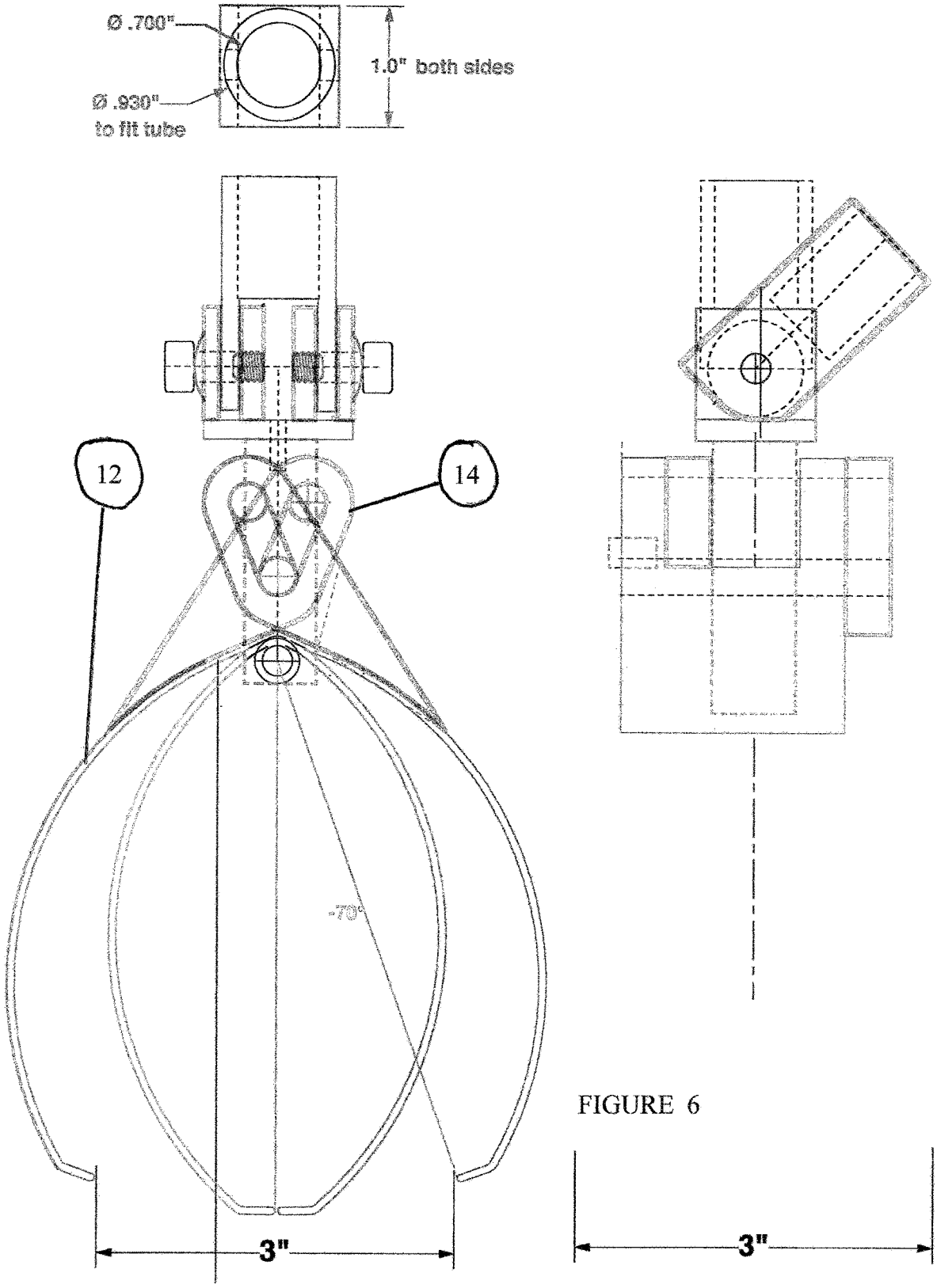
FIG. 6 shows the claws, cams in another embodiment.
Figure 7:
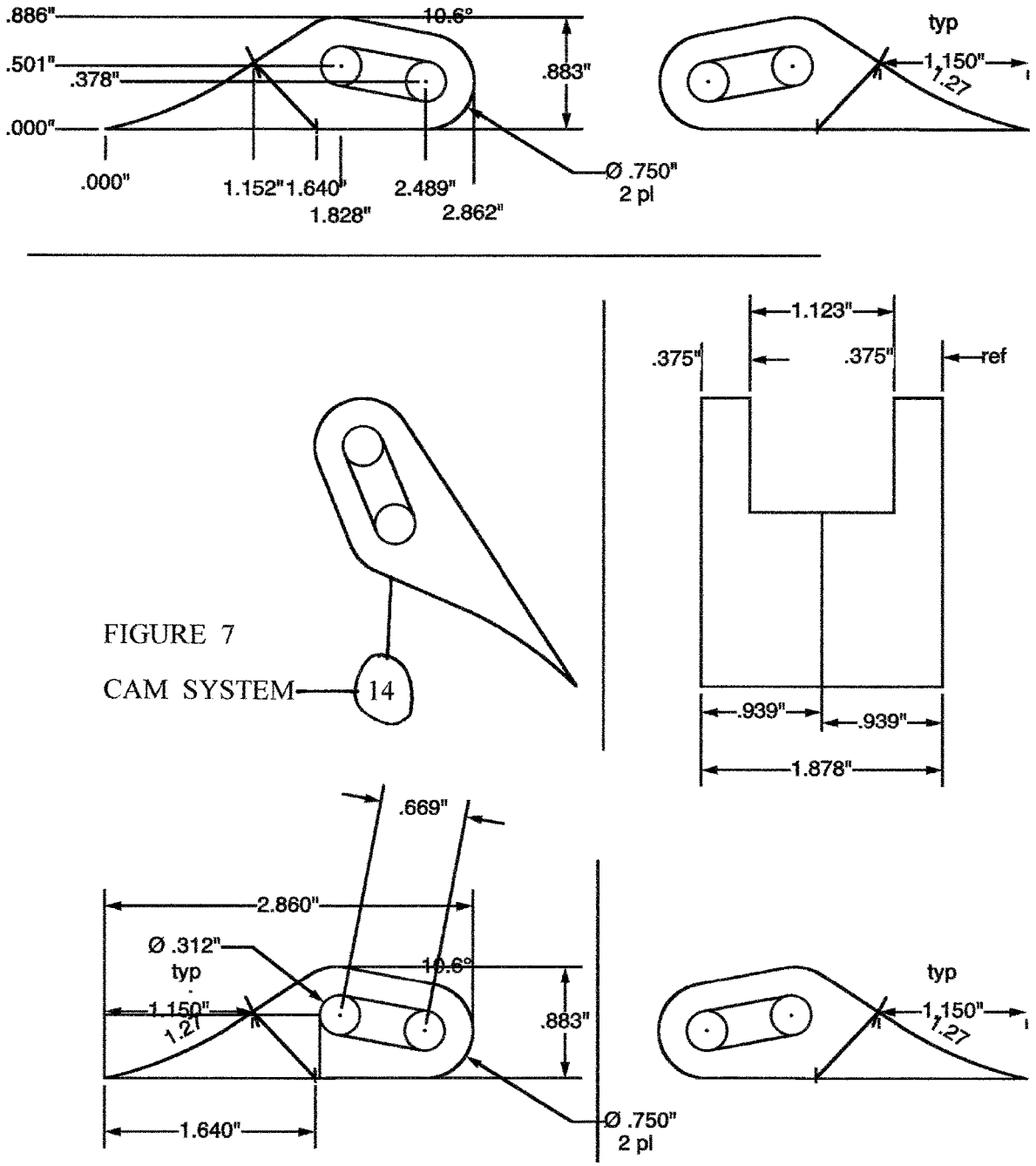
FIG. 7 shows the cams
Figure 8:
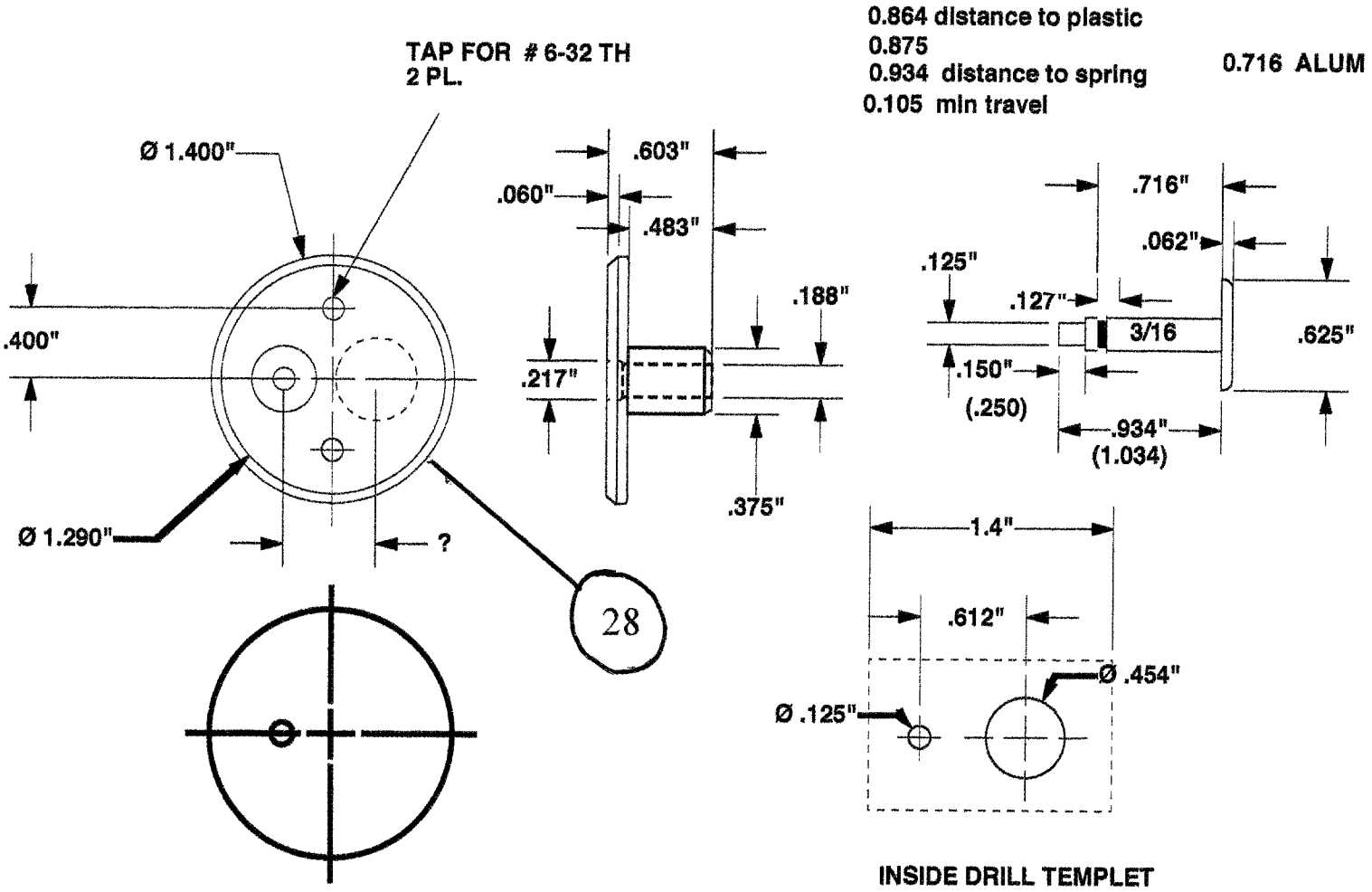
FIG. 8 shows the dog leash break mechanism.
Figure 9:
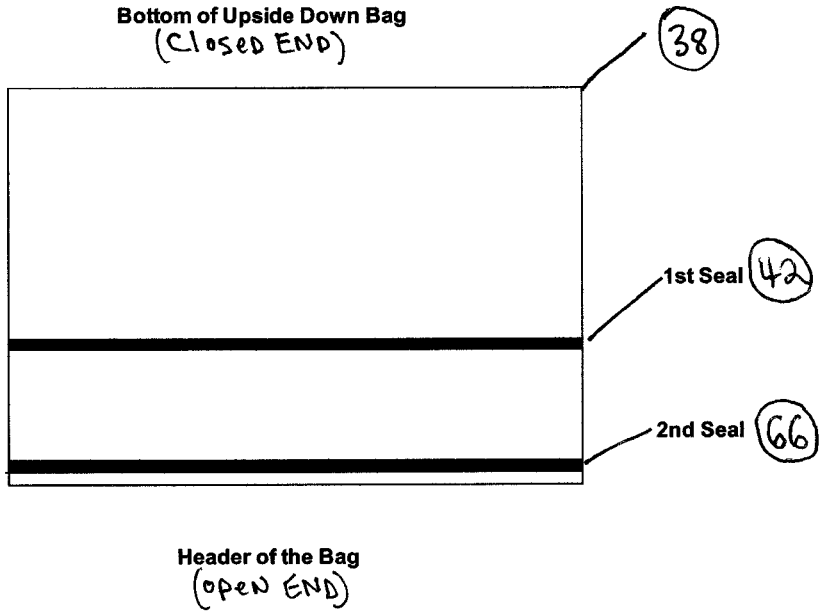
FIG. 9 shows the double sealed plastic bag.

The claws are opened with the trigger. The plates are rolled back into locked positions (ready for release) as shown in the left side of FIG. 3.

The plastic bag (38) is then loaded when the claws are in the open position into the cavity of the claws 12. The plastic bag is then rolled over the claws 12 and then over the plates 34 which are attached to the outside of the claws 12.

The operator first clicks on the first trigger (22) to open the claws 12. The claws 12 are held in the open position, without the operator having to hold on the trigger. The next step is to fold back the plates 34 in locked/ready position which are attached to the outside of the claws 12. The plastic bag 38 is then inserted into the cavity of the claws. The amount of insertion is specified by the first set of Velcro position which should be at the vertical edges of the claws 12. The plastic bag section which is outside the claws is then folded/rolled back over the plates 34 and claws 12. A one time operation is described now. The first trigger can be pressed one more time to close and lock the claws. At the time when service is needed the trigger can be pressed one more time to open the claws 12 with the plastic bag 38. The claws are held over the doggie poop, and the trigger pressed one more time. This action will scoop the doggie poop in to the cavity of the plastic bag 38 and shut the claws 12. The shutting of the claws will seal the plastic bag with the first set of Velcro strips 42. The poop is now in a secure place sealed by the first set of Velcro strips 42. The operator walks with the poop to a designated drop point in the park. At this point the Elite Doggie Scooper is elevated a few inches above the ground at a suggested angle between 10 and 45 degrees, but not limited to these angles only. The second trigger is then pressed, which will then release the spring loaded plates 34 and will unfold and carry the plastic bag into a closed sealed position with the second set of Velcro strips 66. The double seal will ensure that the dog poop will not be accidentally released out of the plastic bag. Without having to touch the poop or the plastic bag, the operator can now walk to the next drop off point. When the operator presses the second trigger, this will allow the claws to open, releases the full plastic bag, and allows the plastic bag 38 to be dropped out into the bin.

The invention claimed is:

1. A scooper device, comprising:

an elongated support structure, having a trigger at a first end and having a pair of openable and closeable claws at an opposite second end;

the elongated support structure having a pivoting part, that allows pivoting of the claws relative to the support structure, a cam system, which transmits force caused by actuating the trigger, to open and close the the claws, the cam system allowing the elongated support structure to bend on the pivoting part while still opening and closing the claws;

a pair of spring loaded outer flaps, coupled to and outside of the claws;

a plastic bag, having an interior cavity and having a first sealable strip, and having a second sealable strip spaced from the first sealable strip, the first and second sealable strips spaced by a distance that allows initially placing the plastic bag inside the claws and outside the outer flaps, the trigger operating to close the claws, where the closing of the claws is operable to scoop a material into the interior cavity of the plastic bag and, where the location of the first sealable strip is such that the closing of the claws seals the first sealable strip, wherein the trigger operating to release the spring loaded outer flaps to a closed sealed position, where the location of the second sealable strip is such that releasing the flaps seals the second sealable strip to double seal the plastic bag with the material therein;

wherein the trigger includes a first trigger that operates the claws, and a second trigger that operates the outer flaps;

wherein the outer flaps are each attached to an outer section of the claws, and movable relative to the outer section of the claws; and a dog leash with a brake/locking mechanism coupled to the first end of the support structure.

2. The device as in claim 1, wherein the outer flaps each are moveable relative to the respective claw.

3. The device as in claim 1, wherein the elongated support structure is a tube.

4. The device as in claim 1, further comprising a flash light with flexible angles, coupled to the support structure.

5. The device as in claim 1, wherein the trigger is self-locking, and locks into an open position where the claws are open.

6. The device as in claim 1, wherein the cam system allows the jaws to open and close.

7. The device as in claim 1, wherein the first and second sealable strips are of hook and loop material.

8. The device as in claim 1, further comprising a pivot that allows the second end to pivot up to 45 degrees.

* * * * *